United States Patent [19]

Karpisek

[11] Patent Number: 4,756,138

[45] Date of Patent: Jul. 12, 1988

[54] METHOD AND APPARATUS FOR WRAPPING

[76] Inventor: Ladislav S. Karpisek, 86 Woodfield Blvd., Caringbah, New South Wales, 2229, Australia

[21] Appl. No.: 10,273

[22] PCT Filed: Apr. 10, 1986

[86] PCT No.: PCT/AU86/00091

§ 371 Date: Dec. 12, 1986

§ 102(e) Date: Dec. 12, 1986

[87] PCT Pub. No.: WO86/06345

PCT Pub. Date: Nov. 6, 1986

[30] Foreign Application Priority Data

Apr. 19, 1985 [AU] Australia ..... PH00220
Apr. 10, 1986 [AU] Australia ..... 55944/86

[51] Int. Cl.[4] ..... B65B 11/02

[52] U.S. Cl. ..... 53/397; 53/441; 53/461; 53/556; 53/567; 53/585; 206/386; 206/597; 108/53.5

[58] Field of Search ..... 53/399, 441, 585, 461, 53/567, 397; 206/386, 597, 600; 108/53.5, 55.1

[56] References Cited

U.S. PATENT DOCUMENTS

| | | | |
|---|---|---|---|
| 181,052 | 8/1876 | DeGray | 53/399 |
| 3,495,375 | 2/1970 | Burhop | 53/556 |
| 4,061,391 | 12/1977 | Violette | 206/597 X |
| 4,354,333 | 10/1982 | McArdle | 53/585 X |
| 4,605,456 | 8/1986 | Annis | 53/399 |

FOREIGN PATENT DOCUMENTS

| | | | |
|---|---|---|---|
| 635330 | 1/1962 | Canada | 206/597 |
| 2534157 | 2/1977 | Fed. Rep. of Germany | 53/586 |
| 2506236 | 11/1982 | France | 206/386 |
| 43593 | 4/1977 | Japan | 206/386 |
| 1570611 | 7/1980 | United Kingdom | 206/386 |

*Primary Examiner*—John Sipos

[57] ABSTRACT

A method and apparatus for forming a protective wrap is disclosed as including a frame made of four upright posts, the upper and lower ends of which engage with upper and lower rigid members, at least one of the posts is rotatable in one direction to apply tension to a plastic wrapper encircling the four posts and is prevented from rotation in the opposite direction by a tensioning handle on the top of the rotated post.

13 Claims, 5 Drawing Sheets

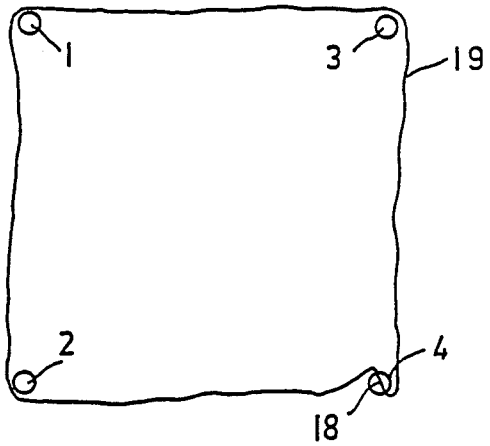
FIG. 3.
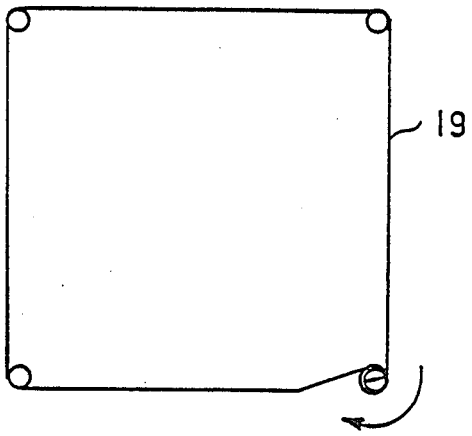
FIG. 4.
FIG. 6.
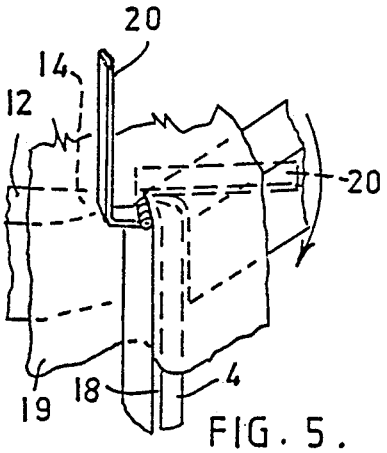
FIG. 5.
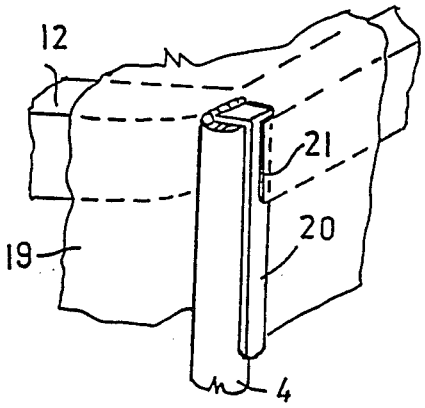

METHOD AND APPARATUS FOR WRAPPING

This invention relates to wrapping loads, groups of articles of regular form such as boxes, bags and the like in a substantially enveloping wrapper of plastic film.

In the materials handling field there has been a number of developments over the years. There has been shrink wrapping, stretch wrapping and stretch-and-shrink wrapping for the wrapping of loads on pallets. There have been pallet cages and pallet based containers to hold goods. There has been racking for use in stores to support loaded pallets so that other loaded pallets can be stored thereon. The present invention incorporates features from many of the foregoing and, as will be readily understood from the following description, the commercial advantages that flow from the proposed invention are substantial.

Broadly, the invention provides a method of wrap protecting goods, comprising the steps of providing a frame having uprights held at their upper and lower ends in fixed spacial relationship to define a storage area where goods to be wrapped can be placed with one of the uprights having a rotational portion adapted to grip wrapping material and rotatable in a first direction and restrained against rotation in the opposite direction, placing a panel of wrapping material around the uprights to encircle said storage area, gripping the wrapping material with the rotatable portion of said one upright and applying a rotational torque to it to produce a required degree of tension in the panel of wrapping material and then discontinuing the application of the torque to allow the restraint against de-tensioning rotation of the rotatable portion to become effective.

The invention further provides a goods protector comprising a frame made up from a plurality of uprights adapted at their upper and lower ends to have those ends respectively engaged with an upper rigid member and a lower rigid member whereby the uprights are located in a fixed spacial relationship, at least one of said uprights includes a portion which is rotatable in a first direction to apply tension to a wrapper of plastic film when placed in encircling relationship around the uprights and when gripped by the rotatable portion so as to draw the wrapper tightly around the frame and rotation preventing means associated with the rotatable portion to prevent it from rotating in the direction opposite to said first direction.

Figure 1:
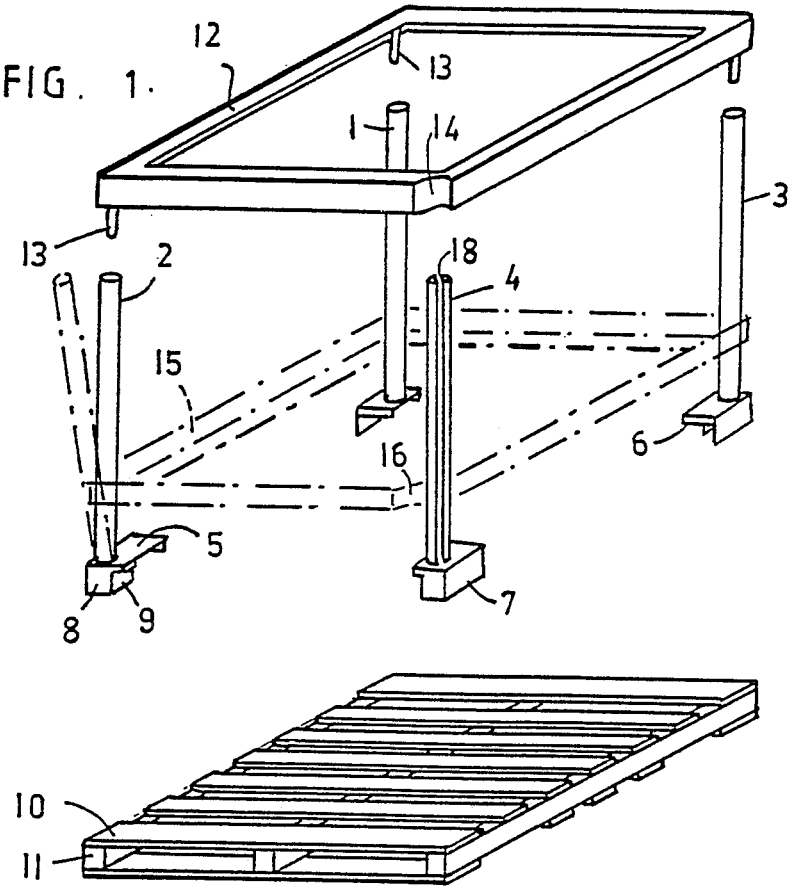
Figure 2:
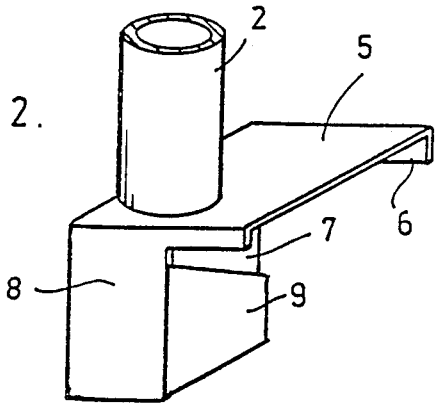
Figure 8:
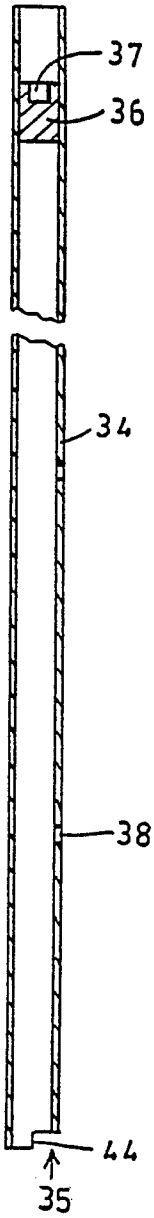
Figure 9:
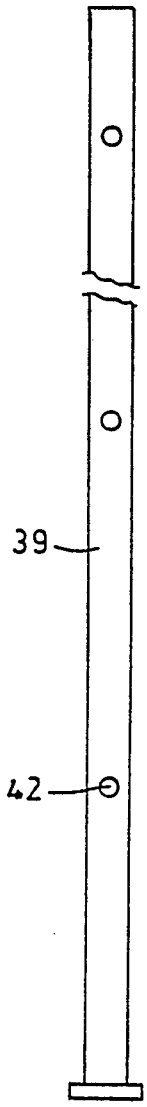
Figure 10:
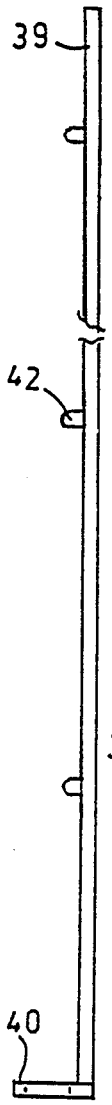
Figure 7:
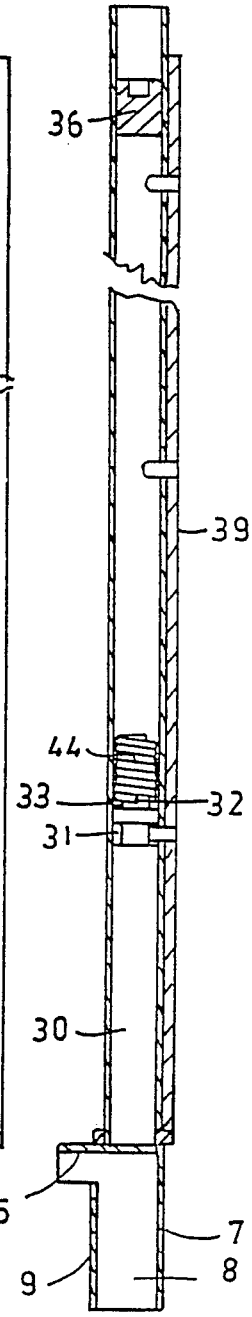
Figure 11:
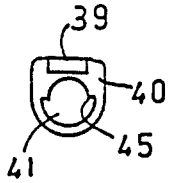
Figure 12:
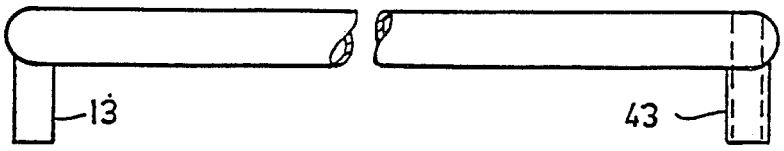
Figure 13:
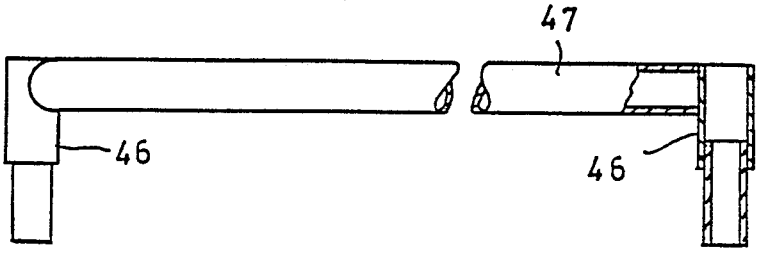
Figure 14:
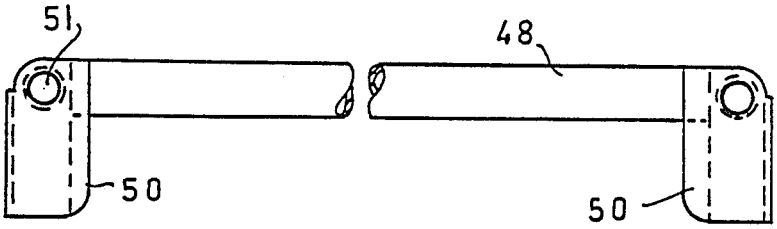
Figure 15:
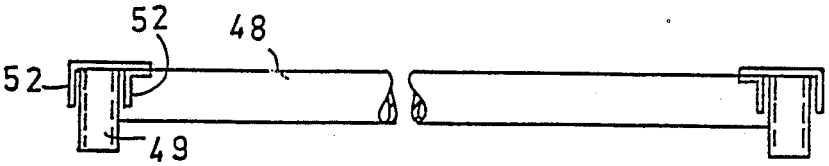
Figure 16:
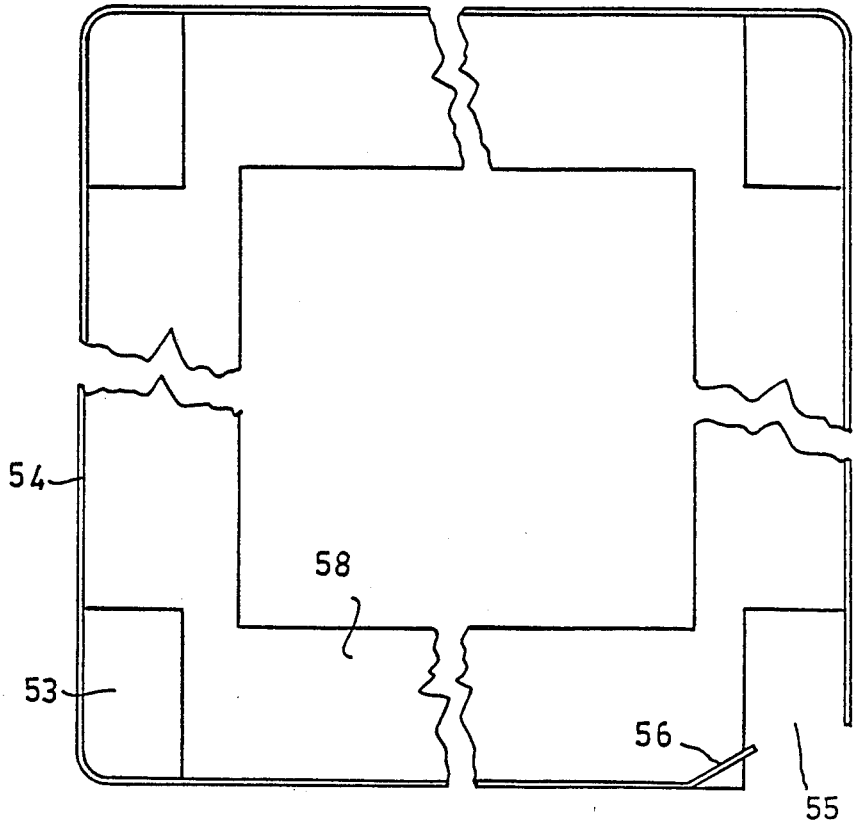
Figure 17:
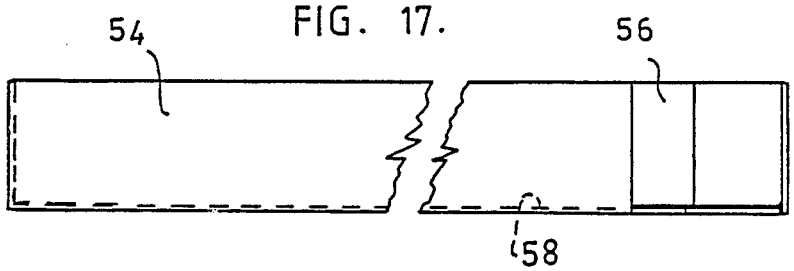

The invention in several forms will now be described with reference to the accompanying drawings in which:

FIG. 1 is an exploded perspective view of a typical arrangement of a first and a second form of the invention, FIG. 2 is an enlarged fragmentary perspective view of a corner connection between an upright and a corner of a pallet, FIG. 3 is a schematic view in plan of a goods protector according to the invention with a plastic wrap bag thereover, FIG. 4 is a view similar to FIG. 3 after the bag has been tensioned and locked in that condition, FIG. 5 is a fragmentary perspective view illustrating a representative form of rotatable upright and its associated handle, FIG. 6 is a view similar to FIG. 5 showing the handle stowed in a locked manner to prevent de-tensioning of the bag, FIG. 7 is a sectional elevation of an assembled further form of a tensioning upright, FIG. 8 is a sectional elevation of the rotatable portion of the upright of FIG. 7, FIG. 9 is a front view of the gripping member of the upright of FIG. 7, FIG. 10 is a side view of the gripping member of FIG. 9, FIG. 11 is a plan view from above of the gripping member of FIG. 7, FIG. 12 is a side elevation of another form of upper rigid frame for the goods protector, FIG. 13. is a side elevation of a component of an upper rigid frame made of disconnectable components, FIG. 14 is a plan view of a component to mate with the component of FIG. 14, FIG. 15 is a side elevation of the FIG. 14 component, FIG. 16 is a plan view of one form of rigid lower frame, and FIG. 17 is a side elevation of the frame of FIG. 16 when looking in the direction of the arrow 17 of FIG. 16.

FIG. 1 is an exploded perspective view of the frame of the invention and comprises four uprights 1,2,3 and 4 each adapted at its lower end to engage boards of a pallet. More particularly and as shown in FIG. 2 the adaption includes a plate 5, a rear lip 6, a side 7, a front flange 8 of stepped shape and tongue 9. When mounted on a pallet the plate 5 sits upon the pallet batten 10 with the lip 6 behind the batten and the end and sides of the bearer 11 housed in a socket provided by the side 7, the tongue 9 and the front flange 8. The method of mounting is to engage the side 7, the flange 8 and the tongue 9 around the end of the bearer 11 with the upright 2 (for example) inclined to the vertical (as shown in broken lines in FIG. 1) and then to pivot the upright to the vertical position to engage the lip 6 behind the batten 10.

When the four uprights are so mounted on a pallet their lower ends are held in fixed spaced relationship. The upper ends of the upright are retained in fixed spaced relationship by the upper member 12 which has pins 13 projecting downwardly and these are engaged in the hollow upper ends of the uprights 1,2 and 3 whilst the upright 4 is housed at its upper ends in a curved notch 14 at one corner of the member 12. In this arrangement the uprights are all tubular and circular in cross-section.

There is a lower member 15 shown in dotted lines in FIG. 1, this may be used to supplement the positioning of the uprights at their lower ends on the pallet or, in an alternate configuration where the frame is for racking and not transport of goods, the pallet may not be used and the lower member 15 will provide the sole positioning means for the lower ends of the uprights 1, 2, 3 and 4. It is to be noted that the lower member 15 is made of angle members with one flange horizontal and lowermost. There would have holes in the inturned horizontal flanges at the corners of the frame 15 with centres the same as the spigots 13 and in fixed relationship to the corners of the pallet to allow the frame 15 to be threaded over the uprights 1 to 4 when mounted on a pallet and be lowered to come to rest upon the tops of the plates 5. The frame 15 has a curved notch 16 to complement the notch 14 of the upper member 12.

The upright 4 is rotatably mounted in its plate 5 and during rotational movement its upper end is journalled in the notch 14. It has a longitudinal substantially diametric slot 18 across it extending substantially its full height.

FIG. 3 schematically shows a typical set-up where a plastic bag or sleeve 19 encircles the uprights 1 to 3 and is slid down the slot 18. See FIG. 5. In FIG. 4 the plastic bag 19 is tensioned and/or stretched by rotation of the upright 4 in a manner that will be readily understood. Tensioning rotation of the upright 4 can be achieved by many means. In the illustrated arrangement the rotation is achieved by torque applied to the handle 20 hingedly mounted on the top of the upright 4, see FIG. 5 where the upright position of the handle 20 is shown in full lines (as would be the position to pierce the end of a plastic bag placed over the frame thereby enabling the operator to gain access to the andle and turn it) and the hinged over torque applying position is shown in broken lines. When the required tension is achieved the handle 20 is folded down to the position shown in FIG. 6 and engaged behind lip 21 at the end of the notch 14. The member 15 when used serves to provide a firm support for the lower edge of the plastic as it is pulled firmly against the member 15 by the application of plastic tensioning force. The bottom member 15 when fitted also serves to retain small articles within the plastic and will deter pilferers who try to pass their hands up under the lower edge of the plastic.

In an alternate arrangement for the prevention of de-tensioning rotation of the upright 4 a ratchet pawl could be provided on the foot of the upright 4 to be engaged in a ratchet wheel fixed to the lower end of the upright 4 and rotatable therewith. The handle 20 could be demountable if desired and alternate tension maintaining means could be provided at the upper and/or the lower end of the upright 4.

The uprights have been described as tubular but they could have other forms. The upright 4 has been described as having a slot from end to end but in alternate arrangements this upright could be a pair of angle irons arranged back to back to provide a square tube with space between the adjacent edges of the flanges thereby providing a diametrical slot as was provided by the slot 18 along the tubular upright 4. In other arrangements the upright 4 could have an adjacent rod or the like parallel to the upright and closely spaced relative thereto.

In variations of the foregoing the upper frame could be replaced by diagonal cross-braces. The uprights 1 to 3 could be adapted, by the addition of longitudinal tracks, to accomodate the edges of panels of, say, plywood which could bear on the upper and lower frames to provide a container effect to give security and protection for the goods within the thus formed container and the plastic could be wrapped around the panels to form a wrapped container. If desired a top panel could be used to complete, with the pallet, a six sided solid walled enclosure or container wrapped in plastic film. To facilitate the tighter wrapping of the lower edge of the plastic, adjacent the pallet top, one or more of the uprights (including the rotating upright 4) could be tapered so as to have the base larger than the top thereby placing more stretch pressure on the lower edge of the bag or tube of plastic.

In another form the upright 4 could be as shown in FIGS. 7 to 11. It comprises a foot unit with the components 5, 6, 7, 8 and 9 as before and the rotational part is a tube 34 (see FIG. 8) with a cut away end part 35. The member 34 at the end 35 is mounted over a spigot 30 fixed to the plate 5. There is a peripheral groove 31 in the spigot and a hole 32 in a reduced diameter end part 33. There is a plug 36 fixed in the member 34 adjacent the upper end thereof and the plug has a socket recess 37 in it to receive a tool whereby torque can be applied to the member 34. At several locations along the length of the member 34 there are holes 38.

For use in conjunction with the member 34 there is a bar 39 (see FIGS. 9 to 11) with a foot 40 having a hole 41 therein one half of which has a radius the same as the member 34 and the other half with a radius the same as the spigot 30. Thus, when the member 34, which has a bore substantially the same diameter as the spigot 30, is placed over the spigot 30 after the hole in the foot 40 has been slid over the spigot the tongue left by the removal of the part 35 of the member 34 will engage in the larger part of the hole 41 in the foot whilst the spigot will fit into the smaller part of the hole 41. Thus there is a driving connection established between the member 34 and the bar 39, where the shoulders 44 and 45 respectively engage, whilst both are rotatably mounted on the spigot 30.

There are pins 42 projecting from the bar 39 and when assembled, as shown in FIG. 7, the pins 42 will enter into the holes 38. As shown in FIG. 7 when the pins are so inserted one engages in the groove 31 in the spigot to prevent the removal of the assembly 34–39 from the spigot. This is a desired and not an essential feature of this form of rotatable upright.

To complete the assembly there is a coiled compression spring 44 mounted on the spigot end 33 with an end of the spring inserted in the hole 32. The spring externally is very close to the size of the bore of the member 34. In known manner the tubular member 34 can be rotated freely on the spring in the direction of the winding of the coils of the spring, such rotation tends to coil the spring tighter and thereby reduce the outside diameter of the spring. Contra-rotation causes the spring to expand and to lock in the bore of the member 34. In this way the member 34 when used for the tensioning of plastic film around the enclosure can be freely rotated in one direction but as soon as the tensioning torque is released and the stretch in the plastic tries to rotate the member 34 in the opposite direction the spring is expanded and locks the member 34 against tension releasing rotation.

As will be understood the rigid one piece upper frame 12 shown in FIG. 1 can be made in other ways. For example, FIG. 12 shows in side elevation a rectangular frame made from tubular members with three spigots 13 to engage in the open ends of uprights 1,2 and 3 and a tubular spigot 43 to receive the upper end of a rotational upright 4 of the FIG. 7 type.

In a representative fabricated frame 12 able to be dismantled for storage and transport, there would be two tie bars as shown in elevation in FIG. 13 comprised of two tubular spigot ends 46 mounted at the opposite ends of a bar 47. FIGS. 14 and 15 are respectively top and elevational views of one of two mating tie bars comprising a bar 48 with a tubular spigot 49 at each end and top plates 50 with holes 51 therethrough aligned with the bores of the spigots 49.

In an assembly, the uprights 1 to 3 would be mounted on three corners of a pallet, the post of FIG. 7 would be mounted on the other pallet corner. The bars of FIG. 13 would be placed between opposed pairs of posts with the spigots 46 inserted into the open upper ends of the posts and the tie bars of FIG. 15 would then be placed with the spigots 49 in the upper ends of the tubular members 46. It is to be noted that there are alignment plates 52 fixed to the underfaces of the plates 50, the spacing apart of the plates 52 is substantially the same as the diameter of the bars 47 so as to provide lateral location for the bars 47 and substantially prevent rotational movement of the spigots 49 in the tubular members 46 and so avoid separation or coming together of diagonal posts.

If desired a bottom security and positioning frame can be used, such a frame is shown in FIGS. 16 and 17. The frame is made from an angle section with corner notches 53 to clear the plates 5 of the posts and the upturned flange 54 supports the bottom region of the plastic wrap material, supports and confines the lowermost articles stacked on the pallet and makes pilfering by access to goods from below more difficult. The frame would be placed over the posts before the attachment of the upper bars 47 and 48.

It is to be noted that at one corner the flange 54 and the base flange 58 are cut away at 55 and a tail end of the flange 54 is inturned at 56. This allows the plastic wrap material to pass behind the rotatable upright 4.

In use the goods would be stacked on the pallet with the frame in place, a plastic bag or sleeve would be placed over the frame with the plastic between the member 34 and 39, the pins 42 would be pressed into the holes 38 to puncture the plastic, a key would be forced through the end of the bag (if a bag was used) to allow the key to enter the socket 37 and the member 34–39 would be rotated to tension the plastic wrapper. The direction of tensioning rotation is that allowed by the spring 44. As soon as the tensioning torque is released contra-rotation due to the tension in the plastic would result in the spring 44 applying a locking force on the member 34 and the plastic would be locked in a stretched condition on the frame members. The only way to release the plastic would be to slit it and so destroy the wrapper.

The advantages of the goods protector are numerous. It consolidates loads of small articles, e.g. boxes, it confines bagged products into a stable load, it achieves the foregoing much more cheaply than other devices for the same purpose, e.g. cages and containers. The apparatus is fully collapsible and therefore easily stored until required and transported to required locations. The apparatus can be made in several heights to accomodate different height loads simply by having uprights of the required height. Stored goods are readily accessible, simply by cutting the plastic one can have access to the goods within the plastic, whereas with cages and containers there are solid doors which need space to open if the goods within the cages or containers are to be removed.

The device lends itself readily to tiering and thus it provides pallet racking at the same time as providing protection for the goods on the pallet.

I claim:

1. A method of forming a protective wrap around a frame defining a goods storage zone, the method comprising the steps of providing a frame having uprights held at their upper and lower ends in fixed spacial relationship to define the goods storage zone, one of the uprights having gripping means to grip wrapping material and being rotatable in a first direction and restraining means to restrain the rotatable upright against rotation in the opposite direction, placing a protective sleeve of wrapping material around the frame to provide sides for the storage zone, gripping the wrapping material with the gripping means, applying rotational torque in the first direction to the rotatable upright to produce a required degree of tension in the wrapping material and then discontinuing the application of the torque to allow the restraining means to become operative.

2. A goods protector comprising a frame made up from a plurality of uprights adapted at their upper and lower ends to have those ends respectively engaged with an upper rigid member and a lower rigid member whereby the uprights are parallel and located in a fixed spacial relationship, at least one of the uprights being rotatable in the first direction, rotation preventing means to prevent the rotation of the rotatable upright in the direction opposite to said first direction, gripping means on the rotatable upright to grip part of a protective sleeve of plastic film in encircling relationship around the frame so as to provide sides for a storage zone within the frame the sleeve being tensioned to draw it tightly around the frame by rotation of the rotatable upright.

3. A goods protector as claimed in claim 2 including a foldable handle at the upper end of the rotatable upright whereby rotational torque can be applied to the rotatable upright when the handle is in an unfolded condition and a latch means on the upper rigid frame engageable when the handle is in a folded position to prevent rotation of the rotatable upright in a direction opposite to the first direction.

4. A goods protector as claimed in claim 2 wherein said rotatable upright is longitudinally slit to provide an anchorage for the wrapping material.

5. A goods protector as claimed in claim 2 having four uprights and the upper and lower ends of the uprights are engaged with the corners of upper and lower rigid rectangular frames.

6. A goods protector as claimed in claim 2 having four uprights and the upper ends of the uprights are engaged at the four corners of an upper rigid frame and the lower ends of the uprights are adapted to interlock with bearers and battens of the pallet at the corners of the pallet.

7. A goods protector as claimed in claim 6 including a lower rigid frame having holes therein to allow the lower rigid frame to pass over the uprights and overlie the pallet.

8. A goods protector as claimed in claim 5 wherein the non-rotatable uprights have hollow upper ends and the upper rigid frame has spigots to engage in the hollow ends of those uprights.

9. A goods protector as claimed in claim 8 wherein the upper end of said rotatable portion is located in a depression in the periphery of the upper rigid frame.

10. A goods protector comprising a frame made up from a plurality of uprights adapted at their upper and lower ends to have those ends respectively engaged with an upper rigid member and a lower rigid member whereby the uprights are located in a fixed spacial relationship, at least one of said uprights includes a portion which is rotatable in a first direction to apply tension to a wrapper of plastic film when placed in encircling relationship around the uprights and when gripped by the rotatable portion so as to draw the wrapper tightly around the frame, and rotation preventing means associated with the rotatable portion to prevent it from rotating in the direction opposite to said first direction, and including four uprights and the upper and lower ends of the uprights are engaged with the corners of upper and lower rigid rectangular frames, wherein the non-rotatable uprights have hollow upper ends and the upper rigid frame has spigots to engage in the hollow ends of those uprights, wherein the upper end of said rotatable portion is located in a depression in the periphery of the upper rigid frame, and wherein said one upright comprises a tubular member rotatable mounted over a spigot fixed to a foot member adapted to interlock with a bearer and a batten at the corner of a pallet, and a helically coiled element with an outside diameter substantially the same as but no larger than the bore of the tubular member mounted within the bore of the tubular member and anchored at tone end to said spigot.

11. A goods protector as claims in claim 10 wherein said rotatable portion has along its length a row of holes and a bar with pins projecting therefrom is coupled to said one upright so as to rotatable with the rotatable portion and so as to be movable laterally relative thereto to allow said pins to engage in and disengage from said holes.

12. A goods protector as claimed in claim 11 wherein said upper rigid member is comprised of interlocking elements.

13. A goods protector as claimed in claim 11 wherein the rotation preventing means is releasable.

* * * * *